US006913089B2

(12) United States Patent
Stirm

(10) Patent No.: US 6,913,089 B2
(45) Date of Patent: Jul. 5, 2005

(54) HAMMER

(75) Inventor: Michael Stirm, Gruenwiesenweg (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/459,975

(22) Filed: Jun. 12, 2003

(65) Prior Publication Data

US 2003/0230424 A1 Dec. 18, 2003

(30) Foreign Application Priority Data

Jun. 12, 2002 (GB) ..... 0213464

(51) Int. Cl.[7] ..... B25D 11/00
(52) U.S. Cl. ..... 173/104; 173/201
(58) Field of Search ..... 173/14, 104, 201

(56) References Cited

U.S. PATENT DOCUMENTS 4,582,144 A * 4/1986 Mizutani ..... 173/14
4,895,212 A * 1/1990 Wache ..... 173/48
5,111,890 A * 5/1992 Ranger et al. ..... 173/104
5,466,100 A 11/1995 Ahluwalia
5,842,527 A * 12/1998 Arakawa et al. ..... 173/48
5,971,403 A * 10/1999 Yahagi et al. ..... 279/19.3
6,073,705 A * 6/2000 Shibata et al. ..... 173/200

FOREIGN PATENT DOCUMENTS

| | | |
|---|---|---|
| DE | 41 36 548 A1 | 5/1993 |
| GB | 2 285 007 | 6/1995 |
| WO | 95/33599 A1 | 12/1995 |
| WO | 02/43982 A2 | 6/2002 |

* cited by examiner

*Primary Examiner*—Rinaldi I. Rada
*Assistant Examiner*—Nathaniel Chukwurah
(74) *Attorney, Agent, or Firm*—Michael P. Leary; Charles E. Yocum; Adan Ayala

(57) ABSTRACT

An electrically powered hammer comprising a hollow cylindrical spindle mounted within a housing. A portion of the spindle is formed with a plurality of circumferentially spaced holes and a corresponding number of peg elements are fitted to the spindle, such that each peg element extends through a corresponding hole in the spindle and radially inwardly of the internal surface of the spindle, in such a way that the peg elements together form an axial stop for one or more additional hammer components located within the spindle. Each peg element may alternatively or additonally extend radially outwardly of the corresponding hole in the spindle, in such a way that the peg elements together form an axial stop for one or more additional hammer components located around the spindle. The axial stops formed by the peg elements can replace circlips, which are generally used to form the axial stops.

18 Claims, 4 Drawing Sheets

HAMMER

BACKGROUND OF INVENTION

This invention relates to electric hammers having an air cushion hammering mechanism.

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more cylindrical parts, which together form the hammer spindle. For example, a front part of the spindle may be formed as a separate tool holder body for retaining the tool or bit. Such hammers are generally provided with an impact mechanism which converts the rotational drive from an electric motor to a reciprocating drive causing a piston, which may be a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Some hammers can be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impacts. A rotary drive mechanism transmits rotary drive from the electric motor to the spindle to cause the spindle, or a forwardmost part thereof to rotate.

The spindle of a hammer generally requires axial stops to be located on it for limiting the axial movement, with respect to the spindle of components which are located both within the hollow spindle and mounted around the hollow spindle.

In known designs of hammer, when the hammer is to be used the forward end of a tool or bit is pressed against a workpiece, which urges the tool or bit rearwardly within the hammer spindle. The tool or bit in turn urges the beatpiece rearwardly into its operating position in which the rearward end of the beatpiece is located within the reciprocating path of the ram. In the operating position the beatpiece receives repeated impacts from the ram. When the hammer is in use, the forward impact from the ram is transmitted through the beatpiece to the bit or tool and through the bit or tool to the workpiece. A reflected impact is reflected from the workpiece and is transmitted through the bit or tool to the beatpiece. This reflected, or reverse impact must be absorbed within the structure of the hammer in such a way that the reverse impacts do not over time destroy the hammer and so that the reverse impacts are not transmitted to the end user.

When the user takes the tool or bit of the hammer away from the workpiece, the next forward impact of the ram on the beatiece urges the beatpiece forwardly into its idle mode position. The beatpiece can move forwardly and stay forwardly because the tool or bit is no longer urging it rearwardly, as the tool or bit can now itself assume a forward idle mode position. Because the beatpiece does not now offer much resistive force against the ram, the ram can also move into a forward idle mode position. In the idle mode position of the ram, the air cushion is generally vented and so any further reciprocation of the piston has no effect on the ram. This forward movement of the components on entry into idle mode generates the greatest impact forces on the structure of the hammer, in particular on the hammer spindle. This is because the forward impact force of these parts on entry into idle mode is not transferred to the workpiece, but has to be absorbed by structure of the hammer itself. Thus, the number of idle strikes, ie. the number of reciprocations of the ram, beatpiece and tool or bit, when the bit or tool is removed from the workpiece need to be minimised in order to minimise the number of high impact force idle strikes that have to be absorbed by the structure of the hammer. This can be achieved by catching the ram and/or the beatpiece in their idle mode positions so that they cannot slip rearwardly to cause the ram to move into a position in which the air cushion is closed and the ram and thus the beatpiece begin to reciprocate again.

Axial stops for limiting forward and rearward movment may be required for components within the spindle, such as a beatpiece catching or ram catching arrangement or a beatpiece guiding arrangement. Axial stops for limiting forward movement may be required for components which transfer idle mode impacts from components within the spindle to the spindle on entry into idle mode. In addition, axial stops for limiting rearward movement may be required for components which transfer reflected impacts from the beatpiece to the spindle during normal operation of the hammer.

Axial stops may also be required for components which are mounted around the spindle. In known designs of rotary hammer an axially moveable spindle drive sleeve or gear may be mounted around the spindle. In a first axial position the sleeve or gear transfers rotary drive from an intermediate drive shaft to the hollow spindle, or a forward part of the hollow spindle and in a second axial position the sleeve or gear does not transfer said rotary drive. The axial position of the spindle drive sleeve or gear is selected via a mode change mechanism actuated by a mode change knob. Axial stops may be required to set the end positions for the axial movement of the spindle drive sleeve or gear. In known designs of rotary hammer, an overload clutch may be mounted around the spindle in association with a spindle drive sleeve or gear for transmitting torque to the spindle only below a predetermined torque threshold. The overload clutch may be loaded by a helical spring which spring is mounted around the spindle and an end stop may be required as a surface against which the spring bears in order to bias the clutch into an engaged position. Known arrangements for enabling a tool holder spindle portion to be removed from or fitted to or rotated with respect to a main spindle portion will comprise components mounted around the spindle which may require axial stops.

Axial stops for components located within the hammer spindle are generally formed by forming the internal surface of the hollow cylindrical spindle so that it has a stepwise increase in its internal diameter, in the axial direction, from the front to the rear of a spindle component part in order to generate one or more annular rearward facing shoulders within the spindle. The annular shoulders can act as axial stops to limit the forward movement of components located within the spindle. Within a single spindle part the internal diameter of the spindle cannot increase and then decrease, as this would make it difficult or impossible to assemble components within the increased internal diameter portion of the spindle. It is generally preferred that the front end of the spindle has the smallest internal diameter as the diameter of the tool or bit, which is to be fitted therein, generally has a smaller diameter than the diameter of the piston and ram which are located within the rearward portion of the spindle.

It should be noted also that a simple spindle structure is preferred with the spindle formed from a single component part or in two parts with a forward tool holder portion of the spindle removeable, so that tool holders can be removed and replaced.

Thus, the annular shoulders are able to provide axial stops against forward movement of components within the spindle, but cannot provide axial stops against rearward movement within the spindle. The general solution for limiting rearward axial movement of components located within the spindle is by the use of metal circlips. The circlips have a generally circular radial cross-section, part of which is received in a corresponding annular groove formed in the internal surface of the spindle, at the desired axial stop location, so that the remaining part of the circlip extends radially inwards beyond the internal surface of the spindle. Thus, the circlip can form an axial stop.

The problem with circlips is that they are difficult to correctly assemble into the hammer spindle. If the circlip is not correctly assembled then the axial stop is not effective and the hammer will not operate correctly. Also, if the circlip is not correctly assembled it is likely to come loose and this is likely to cause damage to the hammer when it is first used.

Alternatively, axial stops for limiting rearward axial movement can be formed by using several separate spindle parts to form the hollow cylindrical spindle, which spindle parts have differing adjacent internal diameters or which spindle parts have other components extending between the separate spindle parts to form end stops. The use of multiple spindle components adds complexity and makes it difficult to seal the interior of the spindle from the ingress of dust.

Similarly, stepwise increases in the external diameter of the spindle can be used to provide annular forward facing shoulders which act as stops for limiting axial rearward movement of components which are mounted around the spindle. Circlips mounted within cooperating grooves formed within the external surface of the spindle or multiple spindle parts are generally used to form axial stops for limiting the axial forward movement of components mounted around the spindle, with the disadvantages set out above.

BRIEF SUMMARY OF THE INVENTION

The present invention aims to provide a hammer arrangement with an effective design of end stop for components located within and/or around the spindle, which overcomes some of the problems associated with circlips and discussed above.

According to the present invention there is provided an electrically powered hammer comprising:

- a hollow cylindrical spindle mounted within a housing of the hammer; and
- an air cushion hammering mechanism located within the spindle for generating repeated impacts on a tool or bit of the hammer;

characterised in that a portion of the spindle is formed with a plurality of circumferentially spaced holes and a corresponding number of peg elements are fitted to the spindle, such that each peg element extends through a corresponding hole in the spindle and radially inwardly of the internal surface of the spindle and/or radially outwardly of the external surface of the spindle, in such a way that the peg elements together form an axial stop for one or more hammer components located within the spindle and/or together form an axial stop for one or more components located around the spindle respectively.

Thus, to assemble an end stop according to the present invention the peg elements are simply located within the corresponding holes within the spindle and fixed in place. This provides an easy to assemble arrangement for generating an axial end stop either within the spindle, around the spindle or both within and around the spindle at the portion of the spindle in which the circumferential holes are formed.

Preferably, each hole in the spindle reduces in its circumferential cross-section from its radially outer end to its radially inner end and the portion of the peg which fits within the hole is correspondingly shaped. The holes are preferably gradually tapered from a relatively large radially outer circumferential cross-section to a relatively small radially inner circumferential cross-section. The taper provides accurate radial positioning for each peg element, so that the axial stops can be formed by peg elements which extend accurately by the same distance outside and/or inside the spindle. In particular, where the holes extend completely through the spindle, the taper will prevent the peg element falling into the spindle.

The portions of the peg elements which extend radially outwardly of the spindle may together form a ring which encircles the spindle portion. This provides a particularly robust end stop design.

A resilient ring may be fitted around the spindle portion, which ring engages each of the peg elements to secure the peg elements to the spindle. The ring may encircle the plurality of peg elements.

In a preferred design there are two peg elements, although there may be more than two peg elements. In some designs two or more peg elements may be formed of a single component part, in order to reduce the number of components required to form the axial stops.

Generally, a tool holder arrangement located at a forward end of the spindle releasably locks the tool or bit within a forward tool holder portion of the spindle so as to enable limited reciprocation of the tool or bit within the spindle;

BRIEF DESCRIPTION OF THE DRAWINGS

An embodiment of a hammer according to the present invention will now be described by way of example, with reference to the accompanying drawings in which.

DETAILED DESCRIPTION

Figure 1:
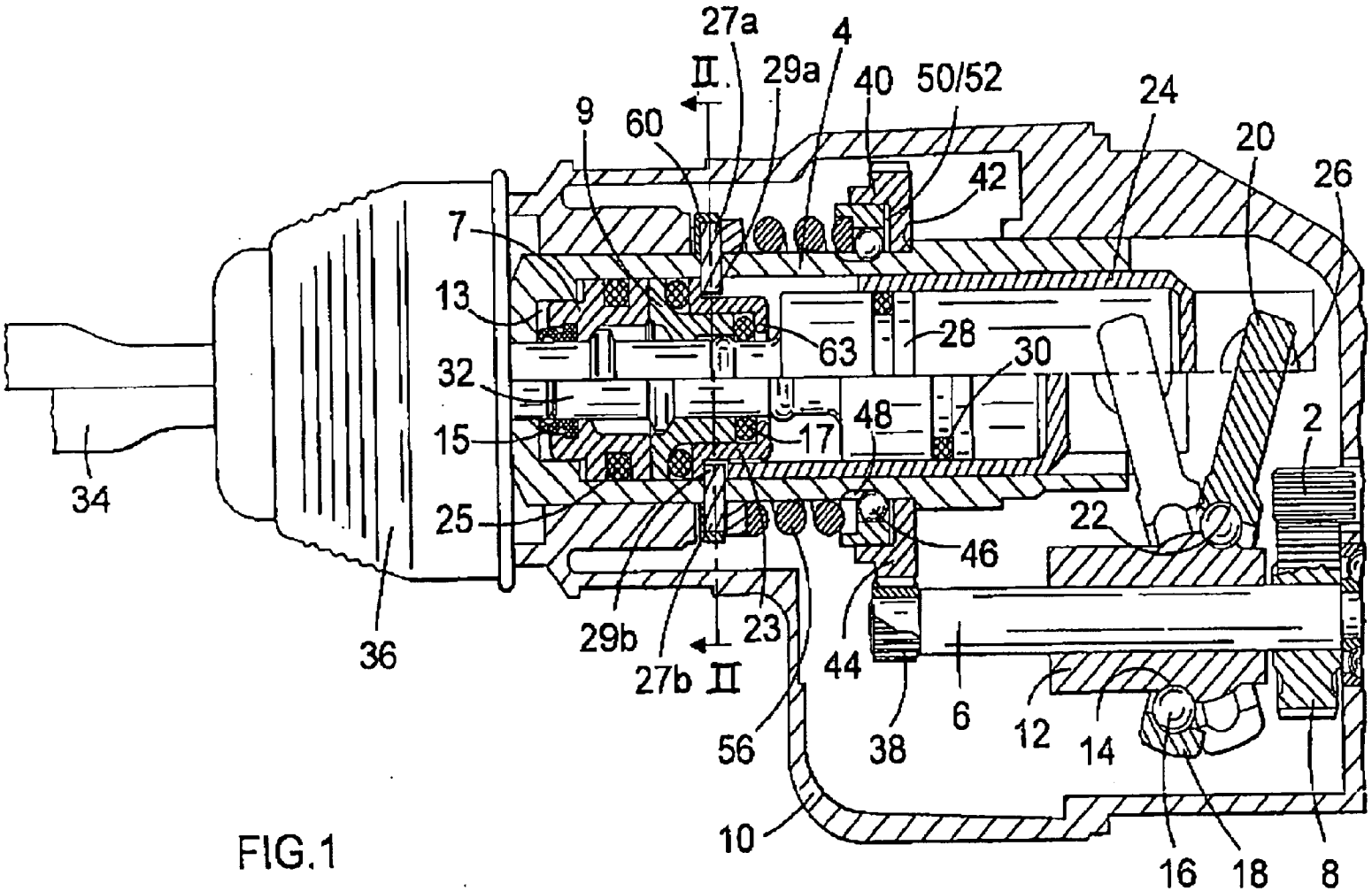
FIG. 1 is a partially cut away longitudinal cross-section of the forward part of a rotary hammer according to the present invention.

The rotary hammer has a forward portion which is shown in FIG. 1 and a rearward portion incorporating a motor and a rear handle, in the conventional way. The handle may be of the pistol grip or D-handle type. The handle portion incorporates a trigger switch for actuating the electric motor, which motor is formed at the forward end of its armature shaft with a pinion (2). The pinion (2) of the motor rotatingly drives an intermediate shaft (6) via a gear (8) which gear is press fit onto the rearward end of the intermediate shaft (6). The intermediate shaft is rotatingly mounted in a forward housing part (10) of the hammer in a conventional manner. In the FIG. 1 arrangement the longitudinal axis of the motor is parallel with the longitudinal axis of the hollow cylindrical spindle (4) of the hammer. Alternatively, the motor could be aligned with its axis perpendicular to the axis of the spindle (4), in which case a bevel pinion would be formed at the end of the armature shaft of the motor, to mesh with a bevel gear press fit on the intermediate shaft (6) replacing the gear (8).

A wobble sleeve (12) is mounted on the intermediate shaft (6) so as to rotate with the intermediate shaft. The wobble sleeve (12) carries the inner race (14) for the ball bearings (16) of a wobble ring (18) from which extends a wobble pin (20). The balls are mounted with the inner race (14) and an outer race (22) formed in the wobble ring (18). Thus, as the wobble sleeve (12) rotates the end of the wobble pin (20) remote from the wobble ring (18) is caused to reciprocate, in order to reciprocatingly drive a hollow cylindrical piston (24). The most rearward position of the wobble pin (20) is shown cross-hatched in FIG. 1 and the most forward position of the wobble pin (20) is shown unshaded in FIG. 1. The end of the wobble pin reciprocatingly drives the piston (24) via a trunnion pin arrangement (26), as is well known in the art.

The hollow cylindrical piston (24) is slideably located within the hollow cylindrical spindle (4). A ram (28) is slideably mounted within the hollow cylindrical piston (24) and an O-ring seal (30) is mounted around the ram (28) so as to seal between the periphery of the ram (28) and the internal surface of the piston (24). During normal operation of the hammer, a closed air cushion is formed between the interior of the piston (24) and the rearward face of the ram (28) and so the ram is reciprocatingly driven by the piston via the closed air cushion. During normal operation of the hammer the ram (28) repeatedly impacts a beapiece (32), which beatpiece is reciprocatingly mounted within the spindle (4). The beatpiece (32) transfers impacts from the ram (28) to a tool or bit (34) mounted within a forward tool holder portion of the spindle (4) by a tool holder arrangement (36). The tool or bit (34) is releasably locked within the tool holder portion of the spindle (4) so as to be able to reciprocate within the tool holder portion of the spindle by a limited amount.

In the lower half of FIG. 1 the, tool (34), beatpiece (32) and ram (28) are shown in their rearward operating position. The hollow spindle (4) is formed in a single part, with a rearward portion which houses the piston (24) and the ram (28) and a forward portion which reduces in diameter in a stepped manner in the forward direction. The spindle (4) is rotatably mounted in the hammer housing (10). The beatpiece (32) is mounted within the spindle between the ram (28) and the tool or bit (34) and is supported and guided by a pair of sleeves (7, 9), which are mounted and guided within the spindle (4).

The beatpiece (32) is formed with an increased external diameter region. The two part sleeve arrangement (7, 9) is used to guide the beatpiece (32) within the spindle. The forward sleeve (7) is formed as a hollow cylinder and has a forward reduced internal diameter guiding portion, which fits around and guides a forward reduced external diameter portion of the beatpiece (32). The rearward sleeve (9) is also formed as a hollow cylinder and has a rearward reduced internal diameter guiding portion, which fits around and guides a rearward reduced external diameter portion of the beatiece (32).

A ram catching sleeve (23) is located within the spindle (4) behind the rearward sleeve (9), partially surrounding the rearward end of the rearward sleeve (9). The ram catching sleeve has a radially inwardly directed flange (63) formed at its rearward end the forward face of which is spaced from the rearward end of the rearward sleeve (9). In this space is located a resilient O-ring (17) for catching the ram in its idle mode position. On entry into idle mode a forward reduced diameter portion of the ram (28) moves forwardly into the rearward end of the ram catching sleeve (23) and an annular nub formed at the front of the reduced diameter portion of the ram (28) is caught in front of the resilient O-ring (17), as shown in the upper half of FIG. 1.

The front sleeve (7) has a mass, which is similar to the mass of the beatpiece (32). A slight axial play in the location of the sleeves (7, 9) within the spindle (4) enables a gap (13) to be created by a resilient seal (15) between a forward facing annular surface of the sleeve (7) and a rearwardly facing shoulder of the spindle (4). During normal operation of the hammer, the gap (13) is maintained by the resilient seal (15). On entry into idle mode, the ram (28) moves into its forward position, in which it is caught in the ram catching O-ring (17). The beatpiece (32) moves into its forwardmost position and the increased diameter portion of the beatpiece impacts a rearward facing internal shoulder of the forward sleeve (7), thus transferring its forward momentum to the front sleeve (7). The reflected momentum from the sleeve (7) causes the beatpiece (32) to then move rearwardly, but not with a sufficient momentum for the beatiece (32) to impact the ram (28) with sufficient force to dislodge the ram (28) from the ram catching O-ring (17).

The front sleeve (7) on being impacted by the beatpiece (64) moves forwardly to close the gap (13) and transfers its forward momentum to the rearward shoulder of the spindle (4). The reflected momentum from the spindle (4) causes the sleeve (7) to move rearwardly, but not with sufficient speed to catch up with the beatpiece (32). The rearward momentum from the front sleeve (7) is transferred to the rear sleeve (9) and from the rear sleeve (9) to the spindle (4) via the damping ring (25), ram catching sleeve (23) and the axial stop pegs (29*a*, 29*b*) described below. Thus, the reflected momentum of the forward sleeve (7) is not transmitted to the beatpiece, which remains in its idle mode position due to the positioning of the ram (28).

Thus, on entry into idle mode the beatpiece and ram are caught in their forward idle mode position by the ram catching ring (17). This means that the ram (28) cannot move rearwardly out of its idle mode position. Thus, the ram (28) is prevented from returning to its operating position in idle mode and so further potentially damaging idle mode impacts are avoided. When the ram (28) is in its forward idle mode position, as shown in the top half of FIG. 1, the air cushion between the piston (24) and ram (28) is vented and so further reciprocation of the piston will not reciprocatingly drive the ram.

When a user wishes to use the hammer again, the tool or bit (34) is pressed against a working surface and so the tool or bit is urged rearwardly in the spindle (4) to urge the beatpiece (32) rearwardly, the beatpiece (32) urges the ram (28) rearwardly and out of the ram catcher (17) to close the vents and form a closed air cushion between the piston (24) and the ram (28). Thus, when the user actuates the trigger switch of the hammer the piston (24) is reciprocatingly driven in the spindle (4) and the ram (28) follows the reciprocation of the piston due to the closed air cushion and hammering occurs.

The rearward sleeve (9) acts to damp reflected impacts to the beatpiece (32) during operation of the hammer. A resilient O-ring (25) is located between a radially outwardly directed flange of the rearward sleeve (9) and the forward end face of the ram catching sleeve (23). The ram catching sleeve (23) is held against rearward movement within the spindle part (40*a*) by the axial stop pegs (29*a*, 29*b*) described below. The O-ring (25) damps the reflected impacts which are transmitted from the working surface, via the tool (34) to the beatpiece (32). The beatpiece (32) transmits these impacts to the sleeve (9), which transmits the impacts via the damping ring (25), which damps the impacts, via the sleeve (23) and pegs (29*a*, 29*b*) to the spindle (4).

Simultaneously with the hammering action described above, the spindle (4) which is rotatingly mounted within the hammer housing (10) is rotatingly driven by the intermediate shaft (6), as described below. Thus, as well as reciprocating, the tool or bit (34) is rotatingly driven because it is non-rotatably mounted within the spindle (4) by the tool holder arrangement (36).

The intermediate shaft (6) is formed at its forward end with a pinion (38) which is in meshing engagement with a spindle drive gear (40). The spindle drive gear (40) is rotatably mounted around the hollow cylindrical spindle (4) against an axial stop formed by a forward facing annular shoulder (42) formed in the external surface of the spindle (4). The shoulder (42) limits movement of the spindle drive gear (40) rearwardly. A clutch ring (44) is non-rotatably mounted around the hollow cylindrical cylinder (4) via a plurality of balls (46). The clutch ring (44) fits within a forward facing recess formed in the spindle drive gear (40). The balls (46) are retained in a plurality of co-operating pockets formed in the clutch ring (44) so that the balls (46) have a portion which extends radially inwardly of the clutch ring (44) in order to engage a respective recess (48) formed in the radially outer surface of the hollow cylindrical spindle (4). Thus, rotation of the clutch ring (44) rotationally drives the hollow cylindrical spindle (4) via the balls (46). The clutch ring (44) is formed with a set of teeth (50) which extend around the periphery of rearward facing surface of the clutch ring (44) and engage a set of cooperating teeth (52) which are formed around the recess in the forward facing recess in the spindle drive gear (40). The clutch ring (44) is rearwardly biased by a helical spring (56) which spring is mounted around the hollow cylindrical spindle (44). The spring (56) biases the teeth (50) of the clutch plate (44) into engagement with the teeth (52) of the spindle drive gear (40).

Thus, when the torque required to rotationally drive the spindle (4) is below a predetermined threshold, the spring (56) biases the teeth (50, 52) into engagement. With the teeth (50, 52) engaged, rotation of the intermediate shaft (6) rotationally drives the spindle drive gear (40) via pinion (38), the spindle drive gear rotationally drives the clutch ring (44) via the interlocking teeth (50, 52) and the clutch ring rotationally drives the hollow cylindrical spindle (4) via the balls (46). However, when the torque required to rotationally drive the spindle (4) exceeds a predetermined torque threshold the clutch plate can move forwardly along the spindle against the biasing force of the spring (56). The recesses (48) in the spindle (4) are axially extended to enable the balls (46) to roll forwardly along the recesses (48) when the clutch ring (44) moves axially forwardly. Thus, the clutch ring (44) begins to slip relative to the spindle drive gear (40) and the teeth (50, 52) ratchet over each other, and so the rotary drive from the spindle drive gear (40) is not transmitted to the spindle (4). The ratcheting of the teeth (50, 52) makes a noise which alerts the user of the hammer to the fact that the overload clutch arrangement (40, 44, 56) is slipping.

In the arrangement described above a rearward axial stop (29) is required for components within the spindle (4) to limit the axially rearward movement of the ram catching sleeve (23) and thus limit axially rearward movement of the sleeve (7, 9). As described below, the rearward axial stop (29) transmits the reflected impact from the beatpiece (32) to the spindle (4) via sleeve (9) and damping ring (25) during normal operation of the hammer. The rearward axial stop (29) also transmits the rearward impact from the sleeve (9), via the damping ring (25) on entry into idle mode. Also, a forward axial stop (27) is required for components mounted around the spindle (4) to limit forward movement of the forward end of the helical spring (56) of the overload clutch arrangement.

Figure 2:
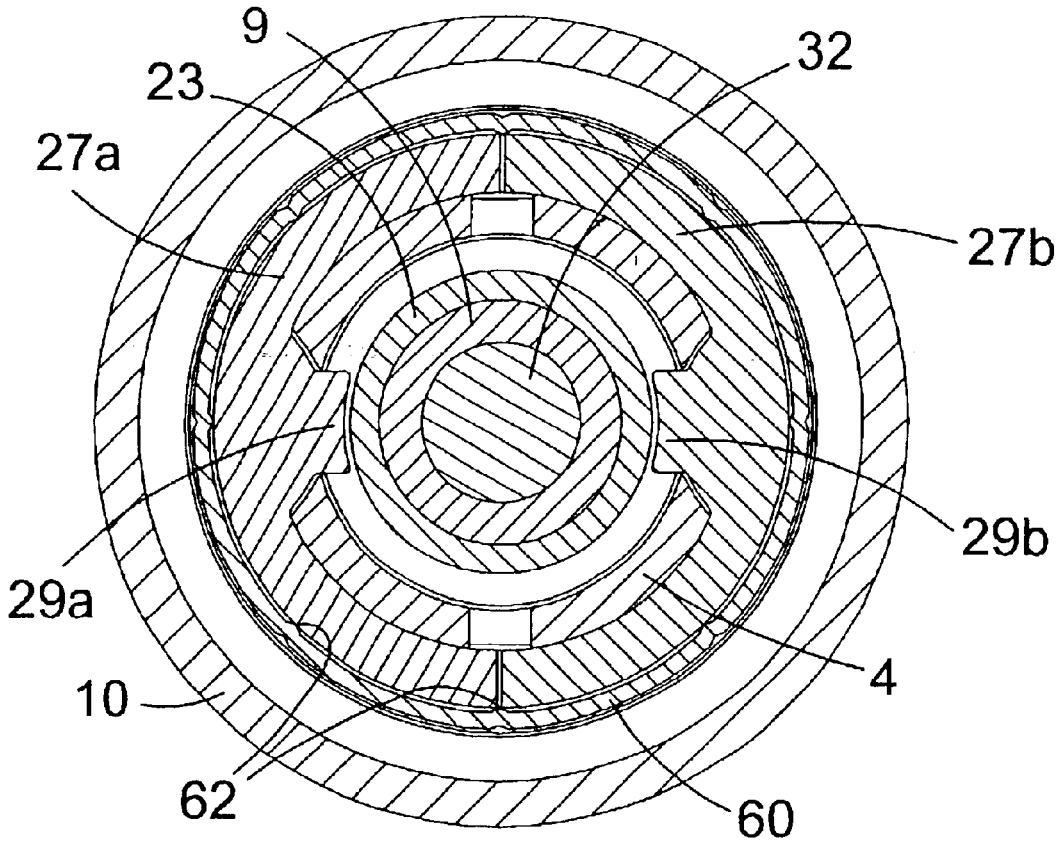
FIG. 2 is a transverse cross section through line II—II of FIG. 1.
Figure 3:
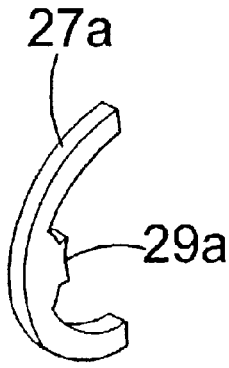
FIG. 3 is a perspective view of one of the two half ring peg elements of FIGS. 1 and 2.

The axial stops are provided by two peg elements each formed as a half ring portion (27*a*, 27*b*) with an associated radially inward extending peg (29*a*, 29*b*), as shown in FIGS. 2 and 3. Each peg (29*a*, 29*b*) has a tapered section, which reduces in circumferential width from the adjacent ring portion (27*a*, 27*b*), to terminate in an end section of a reduced circumferential width, which end section extends further radially inwardly with a constant width. The radially inward facing surface at the radially inner end of each peg (29*a*, 29*b*) is curved to match the curvature of the radially outer surface of the ram catching sleeve (23).

Figure 7:
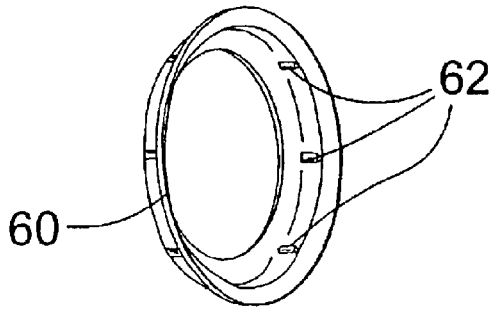
FIG. 7 is a perspective view of a covering ring for fixing the peg elements to the hammer spindle in the arrangements of FIGS. 1, 2, 4 and 6.

The half ring portions (27*a*, 27*b*) are fitted around the spindle (4) with the pegs (29*a*, 29*b*), extending through two associated holes formed completely through the side wall of the hollow cylindrical cylinder (4). The holes are circumferentially spaced around a portion of the spindle where the axial stops are required, so that the holes are on opposite sides of the portion of the spindle. The half ring portions (27*a*, 27*b*) together form a ring which completely encircles the hollow cylindrical spindle (4). The half ring portions (27*a*, 27*b*) are secured on the spindle (4) via a resilient covering ring (60), which is shown in FIG. 7. The resilient covering ring has an L-shaped radial cross-section with a first arm extending in the radial direction and abutting the forward facing faces of the half ring portions (27*a*, 27*b*) and with a second arm extending in the axial direction and closely fitting over the radially outer periphery of the half ring portions (27*a*, 27*b*). The covering ring (60) is formed with a plurality of fixing ribs (62) on its radially inward facing surface, which ribs frictionally engage the radially outer peripheral surface of the half ring portions (27*a*, 27*b*) to fix the covering ring (60) securely over the half ring portions (27*a*, 27*b*).

The tapered section of each peg (29*a*, 29*b*) fits within the holes formed through the side wall of the spindle, which holes are correspondingly tapered. The radially inner end of each peg (29*a*, 29*b*) extends radially within the cylindrical spindle (4) to form an axial stop for the ram catching ring (23), as described above. The half ring portions (27*a*, 27*b*) form an axial stop for the spring (56) of the overload clutch, as described above.

It should be noted that in other configurations of rotary hammer, the peg element and cover ring arrangement (27*a*, 27*b*, 29*a*, 29*b*, 30) described above could be used to form end stops to other components mounted around or within the hollow cylindrical spindle of a hammer. Other components which may require such end stops are discussed above.

Figure 4:
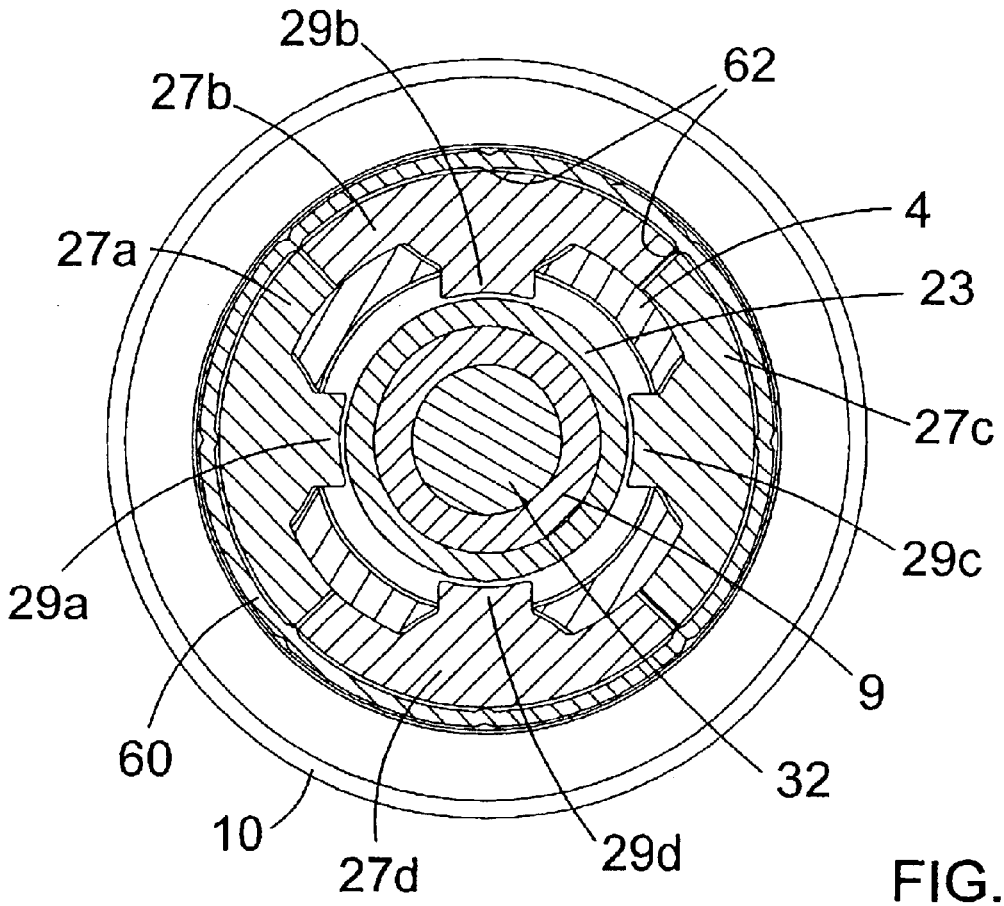
FIG. 4 is a transverse cross-section of an end stop arrangement mounted on a spindle of a rotary hammer according to a second embodiment of the present invention wherein the end stop comprises four quarter ring peg elements.
Figure 5:
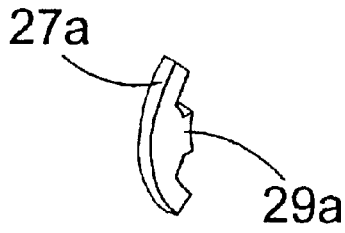
FIG. 5 is a perspective view of one of the four peg elements of FIG. 4.
Figure 6:
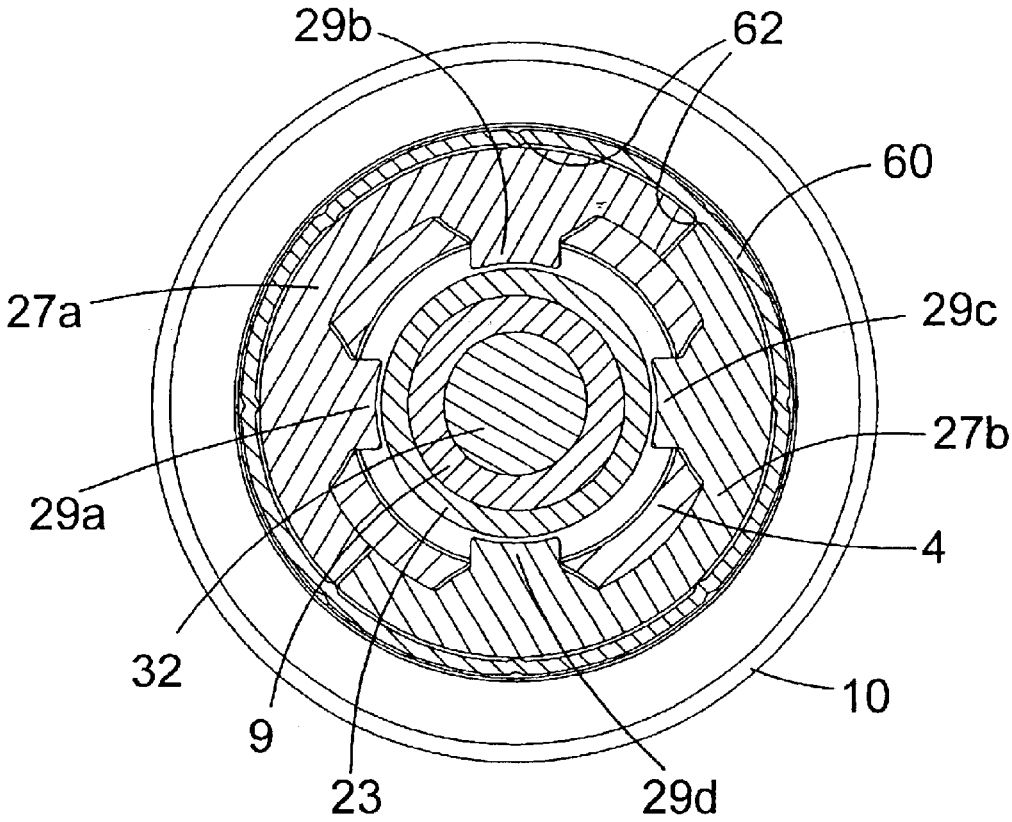
FIG. 6 is a transverse cross-section of an end stop arrangement mounted on a spindle of a rotary hammer according to a third embodiment of the present invention wherein the end stop comprises two half ring double peg elements.

Additionally, the ring (27) could be formed from more than two portions and could, for example be formed from three third ring portions or four quarter ring portions. An embodiment using four quarter ring portions (27*a*–*d*), each carrying an associated peg (29*a*–9) is shown in FIGS. 4 and 5, with like parts identified with like numerals. The number of pegs (29*a*, 29*b*) is not limited to two and, for example, each of the two half rings (27*a*, 27*b*) could be formed with two pegs each, as shown in FIG. 6, to form four pegs (29*a*–*d*) which act as axial end stops within the hollow cylinder.

The hammer described above is a single mode rotary hammer, in which when the motor is actuated the tool or bit (34) is caused to rotate and the tool or bit (34) is repeatedly impacted and so reciprocates. The half ring and cover ring arrangement described above for providing axial end stops to components within and mounted around the hollow cylindrical spindle of a hammer is equally applicable to other types of hammer which operate in one or more of the following three modes, drilling only mode in which the tool or bit is rotatingly driven only, chisel only mode in which the tool or bit is caused to reciprocate only, and rotary hammer mode in which the tool or bit is simultaneously rotated and caused to reciprocate.

What is claimed is:

1. An electrically powered hammer comprising:

a housing;

a hollow cylindrical spindle mounted within the housing and including an internal surface and an external surface and defining at least one radial hole;

a hammer component located within the spindle;

a spring located around the exterior of surface of the spindle;

a peg element fitted to the spindle through the radial hole in the spindle, the peg element including a first portion extending radially inwardly of the internal surface of the spindle in such a way that the first portion forms an axial stop for the hammer component, and the peg element including a second portion extending radially outwardly of the external surface of the spindle in such a way that the second portion forms an axial stop for the spring.

2. A hammer according to claim 1 wherein the radial hole in the spindle is defined by a radially inner end, a radially outer end, and a circumferential cross section, and wherein the circumferential cross-section decreases from the radially outer end to the radially inner end and the portion of the peg element which fits within the hole is correspondingly shaped.

3. A hammer according to claim 1 and further comprising a hammer component located on the exterior surface of the spindle and wherein the peg element includes a portion extending radially outward of the radial hole in such a way that the peg element forms an axial stop for the hammer component located on the exterior surface of the spindle.

4. A hammer according to claim 3 wherein the portion of the peg element which extends radially outwardly of the spindle forms a ring segment which partially encircles the spindle.

5. A hammer according to claim 1 and further comprising a resilient ring fitted around the spindle, which ring engages the peg element to secure the peg element to the spindle.

6. A hammer according to claim 1 and further comprising a second peg element.

7. A hammer according to claim 6 wherein the resilient ring encircles the peg element and the second peg element.

8. A hammer according to claim 1 and wherein the portion of the peg element extending through the radial hole is a first radially inward portion and the peg element includes a second radially inward portion that extends through a second radial hole in the spindle and radially inwardly of the internal surface of the spindle.

9. A hammer according to claim 1 additionally comprising a tool holder arrangement located at a forward end of the spindle for releasably holding the working accessory within a forward tool holder portion of the spindle so as to enable limited reciprocation of the working accessory within the spindle.

10. An electrically powered hammer comprising:

a housing;

a hollow cylindrical spindle mounted within the housing and including an internal surface and an external surface and defining a plurality of radial holes;

a hammer component located within the spindle;

a spring located around the exterior of surface of the spindle;

a plurality of peg elements fitted to the spindle, the peg elements include a first portion extending through the holes in the spindle and radially inwardly of the internal surface of the spindle, in such a way that the first portion of the peg elements forms an axial stop for the hammer component, and the peg elements include a second portion extending radially outwardly of the external surface of the spindle in such a way that the second portions of the peg elements forms an axial stop for the spring.

11. A hammer according to claim 10 and further comprising a hammer component located on the exterior surface of the spindle and wherein the peg elements include a portion extending radially outward of the holes in such a way that the peg elements form an axial stop for the hammer component located on the exterior surface of the spindle.

12. A hammer according to claim 11 wherein the portions of the peg elements which extend radially outward of the holes together form a ring which encircles the spindle.

13. A hammer according to claim 10 and further comprising a covering ring fitted around the spindle and engaging the peg elements to secure the peg elements to the spindle.

14. A hammer according to claim 13 and wherein the covering ring is a resilient ring.

15. A hammer according to claim 10 and wherein the portion of each of the peg elements extending through the radial hole is a first radially inward portion and each of the peg elements includes a second radially inward portion that extends through a second radial hole in the spindle and radially inwardly of the internal surface of the spindle.

16. An electrically powered hammer comprising:

a housing;

a hollow cylindrical spindle mounted within the housing and including an internal surface and an external surface and defining at least one radial hole, the radial hole in the spindle is defined by a radially inner end, a radially outer end, and a circumferential cross section, and wherein the circumferential cross-section decreases from the radially outer end to the radially inner end;

a hammer component located within the spindle;

a peg element fitted to the spindle through the radial hole, a first portion of the peg element fits within the hole and is shaped to correspond to the decreasing cross section of the hole, a second portion of the peg element extends radially inwardly of the internal surface of the spindle, in such a way that the peg element forms an axial stop for the hammer component.

17. An electrically powered hammer comprising:

a housing;

a hollow cylindrical spindle mounted within the housing and including an internal surface and an external surface and defining a first radial hole and a second radial hole;

a hammer component located within the spindle;

a peg element fitted to the spindle, such that a first portion of the peg element extends through the first radial hole in the spindle and radially inwardly of the internal surface of the spindle and a second portion of the peg element extends through the second radial hole in the spindle and radially inwardly of the internal surface of the spindle, and the first portion of the peg element forms a first axial stop for the hammer component and the second portion of the peg element forms a second axial stop for the hammer component.

18. An electrically powered hammer comprising:

a housing;

a hollow cylindrical spindle mounted within the housing and including an internal surface and an external surface and defining a plurality of radial holes;

a hammer component located within the spindle;

a second hammer component located on the exterior surface of the spindle;

a plurality of peg elements fitted to the spindle, such that a first portion of the peg elements extend through the holes in the spindle and radially inwardly of the internal surface of the spindle, in such a way that the peg elements forms an axial stop for the hammer component, and the peg elements include a second portion extending radially outward of the holes in such a way that the peg elements form an axial stop for the second hammer component located on the exterior surface of the spindle, and the second portions of the peg elements which extend radially outward of the holes together form a ring which encircles the spindle.

* * * * *